US009929544B1

(12) United States Patent
Swords

(10) Patent No.: US 9,929,544 B1
(45) Date of Patent: Mar. 27, 2018

(54) SPARK PLUG GAPPING TOOL

(71) Applicant: Michael Swords, Covington, LA (US)

(72) Inventor: Michael Swords, Covington, LA (US)

( * ) Notice: Subject to any disclaimer, the term of this patent is extended or adjusted under 35 U.S.C. 154(b) by 0 days.

(21) Appl. No.: 15/658,617

(22) Filed: Jul. 25, 2017

(51) Int. Cl.

| | |
|---|---|
| ***B21D 26/00*** | (2006.01) |
| ***H01T 21/02*** | (2006.01) |
| ***B21D 7/00*** | (2006.01) |
| ***B21D 5/01*** | (2006.01) |
| *H01T 13/32* | (2006.01) |

(52) U.S. Cl.
CPC ..... *H01T 21/02* (2013.01); *B21D 5/01* (2013.01); *B21D 7/00* (2013.01); *B21D 26/00* (2013.01); *H01T 13/32* (2013.01)

(58) Field of Classification Search
CPC .. B21D 26/00; B21D 5/01; B21D 7/00; H01T 21/02
USPC ..... 72/460
See application file for complete search history.

(56) References Cited

U.S. PATENT DOCUMENTS

| | | | | |
|---|---|---|---|---|
| 1,812,496 | A * | 6/1931 | Rabezzana | H01T 21/06 72/458 |
| 2,235,172 | A | 3/1941 | Schulz | |
| 2,492,380 | A | 12/1949 | Stephen | |
| 2,645,142 | A | 7/1953 | Schwenzfeier | |
| 2,664,135 | A * | 12/1953 | Oden, Sr. | H01T 21/06 445/67 |
| 2,670,643 | A * | 3/1954 | Clark | B25B 7/02 7/100 |
| 2,871,741 | A | 2/1959 | Weisbeicker | |
| 3,777,535 | A | 12/1973 | Paxton | |
| 3,898,829 | A | 8/1975 | Sydow | |
| D282,143 | S | 1/1986 | Tarquinio | |
| 4,589,153 | A | 5/1986 | Paquette | |
| 5,471,759 | A | 12/1995 | Burrows | |

FOREIGN PATENT DOCUMENTS

| | | | |
|---|---|---|---|
| GB | 861934 | A | 3/1961 |

* cited by examiner

*Primary Examiner* — David B Jones

(57) ABSTRACT

The spark plug gapping tool comprises a clamp that provides a spark plug holder on a lower arm that is vertically aligned with a threaded shaft and a pressing foot on an upper arm. An inverted spark plug may be installed into the spark plug gapping tool from the bottom side of the lower arm. A mounting clip on the clamp allows a gap gauge to be removably coupled to the clamp and the gap gauge provides a calibrated arm of a specific thickness, which the spark plug gap is to match. A handle on the threaded shaft allows the threaded shaft to be turned, causing the threaded shaft to move up and down within a threaded shaft hole. Downward movement of the pressing foot against an electrode of the spark plug bends the electrode and sets the spark plug gap.

5 Claims, 4 Drawing Sheets

SPARK PLUG GAPPING TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of vehicle servicing, more specifically, a spark plug gapping tool.

SUMMARY OF INVENTION

The spark plug gapping tool comprises a clamp that provides a spark plug holder on a lower arm that is vertically aligned with a threaded shaft and a pressing foot on an upper arm. An inverted spark plug may be installed into the spark plug gapping tool from the bottom side of the lower arm. A mounting clip on the clamp allows a gap gauge to be removably coupled to the clamp and the gap gauge provides a calibrated arm of a specific thickness which the spark plug gap is to match. A handle on the threaded shaft allows the threaded shaft to be turned, causing the threaded shaft to move up and down within a threaded shaft hole. Downward movement of the pressing foot against an electrode of the spark plug bends the electrode and sets the spark plug gap.

An object of the invention is to allow a spark plug gap to be precisely set.

Another object of the invention is to provide a tool relying on mechanical advantage of a threaded shaft to apply pressure needed to bend an electrode on a spark plug.

A further object of the invention is to provide a set of calibrated gap gauges that removably couple to the spark plug gapping tool.

These together with additional objects, features and advantages of the spark plug gapping tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the spark plug gapping tool in detail, it is to be understood that the spark plug gapping tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the spark plug gapping tool.

It is therefore important that the claims be regarded as including such equivalent construction insofar as they do not depart from the spirit and scope of the spark plug gapping tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
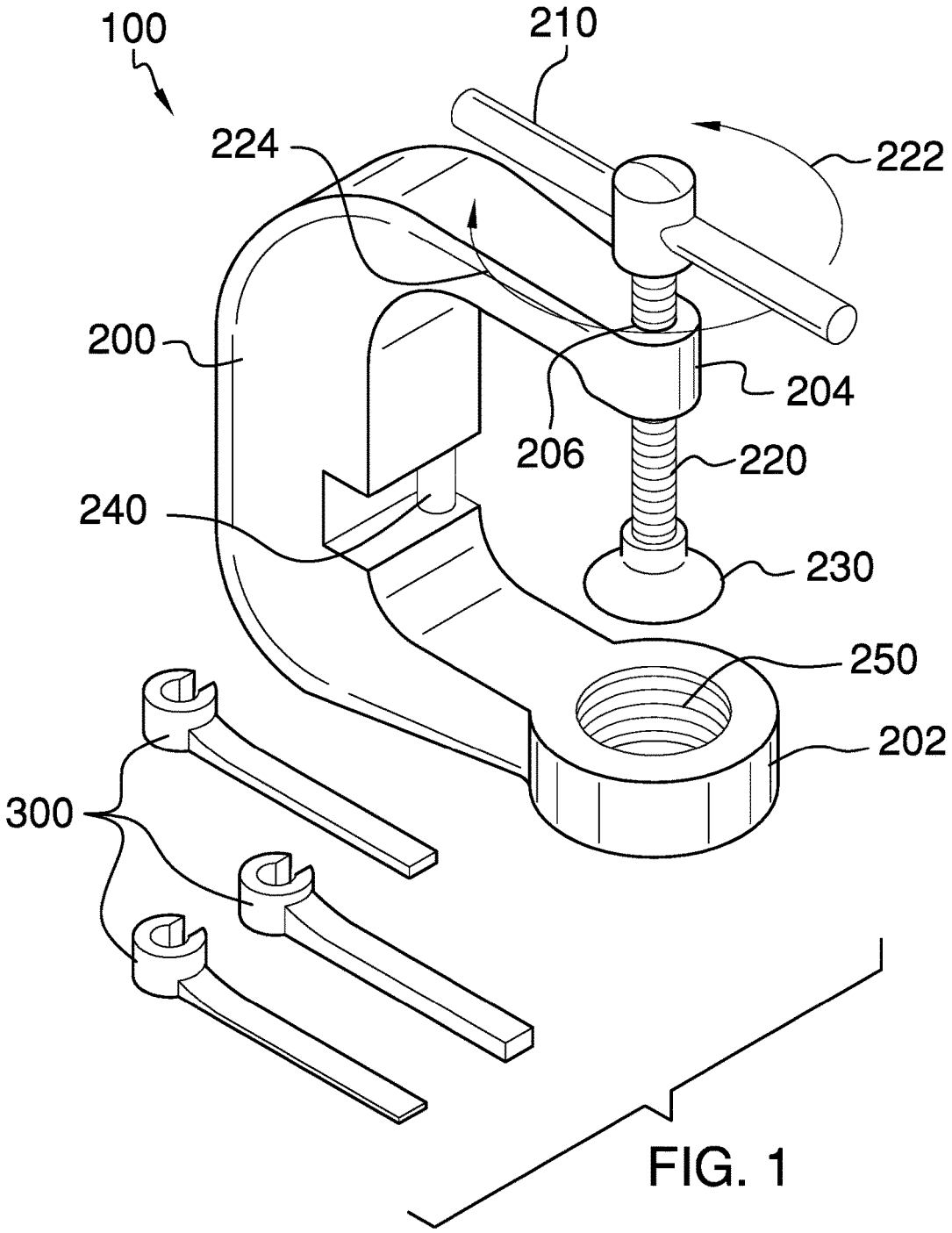
FIG. 1 is a perspective view of an embodiment of the disclosure.
Figure 2:
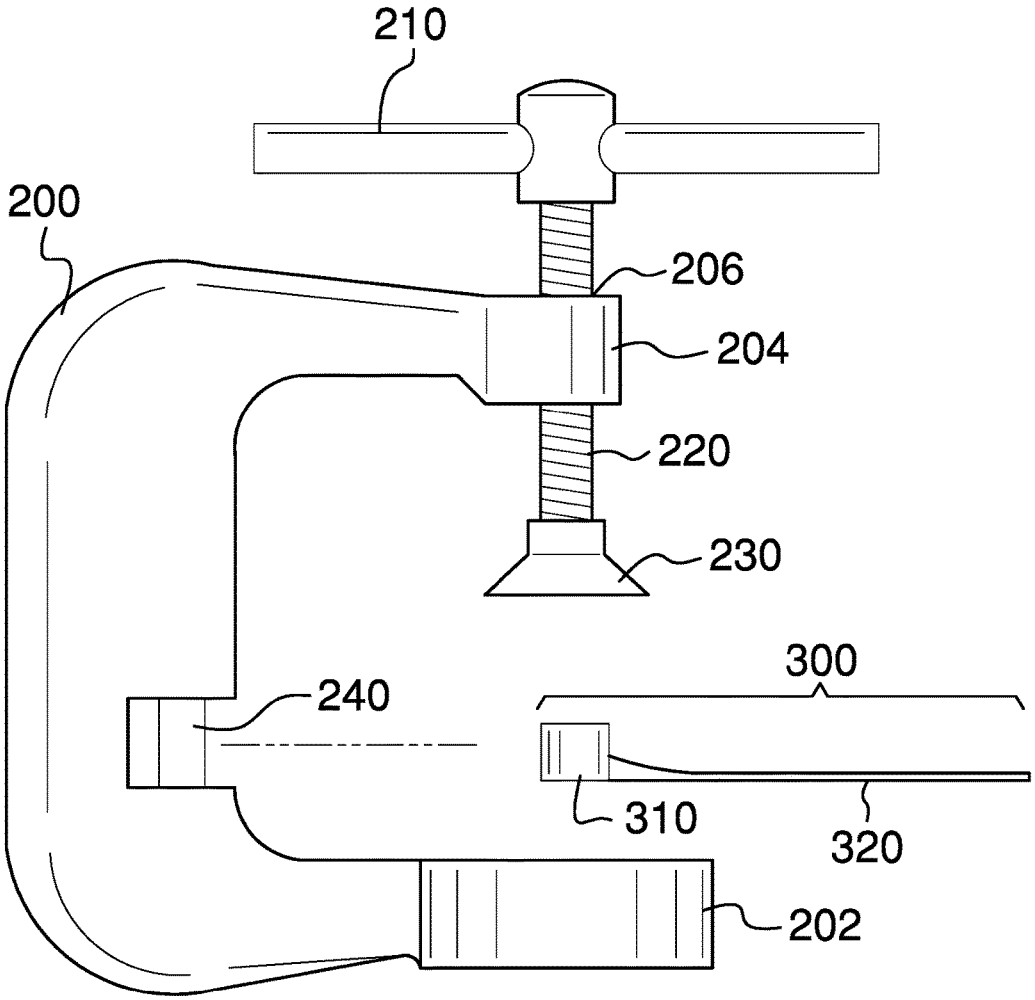
FIG. 2 is a side view of an embodiment of the disclosure.
Figure 3:
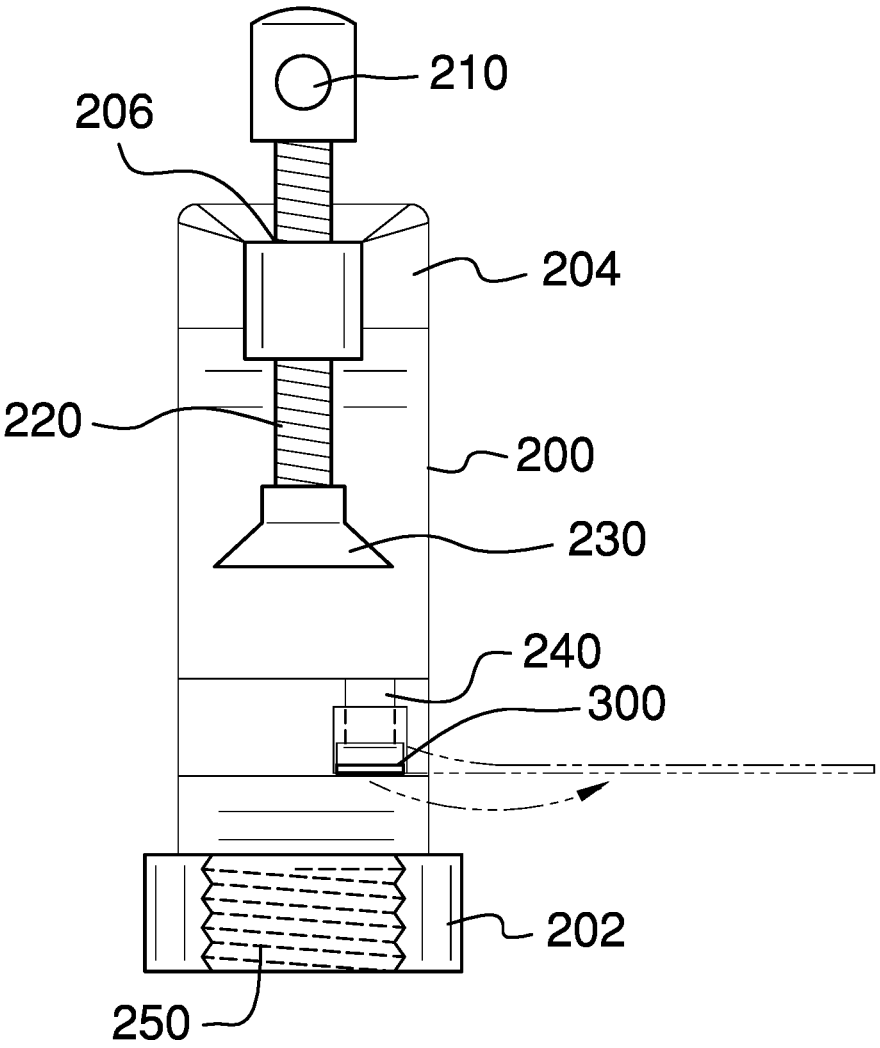
FIG. 3 is a front view of an embodiment of the disclosure.
Figure 4:
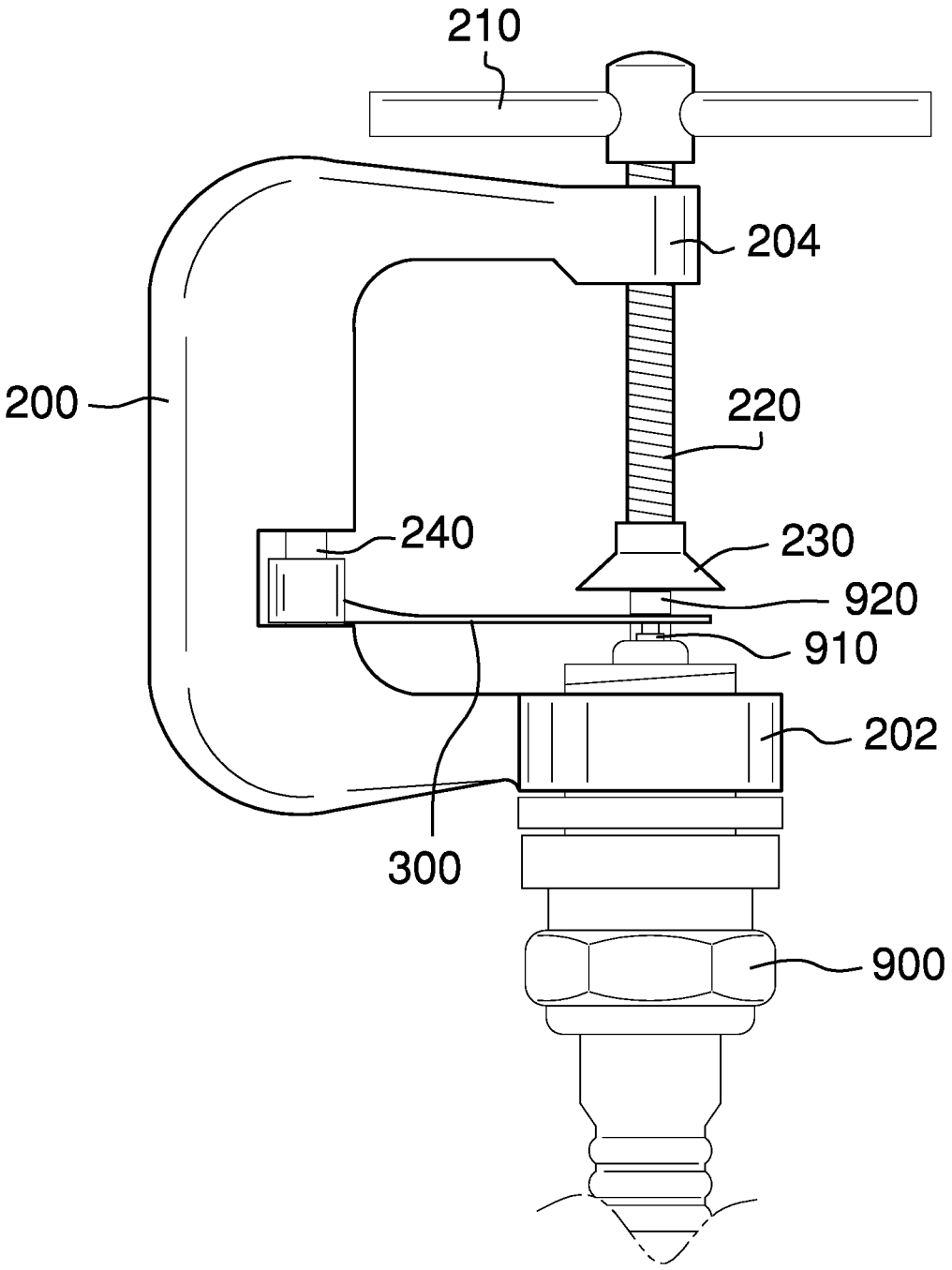
FIG. 4 is an in-use view of an embodiment of the disclosure.

Detailed reference will now be made to a first potential embodiment of the disclosure, which is illustrated in FIGS. 1 through 4.

The spark plug gapping tool 100 (hereinafter invention) comprises a clamp 200, a handle 210, a threaded shaft 220, a pressing foot 230, a gauge mount 240, a spark plug holder 250 and one or more gap gauges 300. The invention 100 accepts a spark plug 900 into the spark plug holder 250 and allows the pressing foot 230 to to bend a lateral electrode 920 of the spark plug 900 until a gap width of the spark plug 900 is set correctly, as determined by having a selected one of the one or more gap gauges 300 fill the space between a central electrode 910 of the spark plug 900 and the lateral electrode 920 of the spark plug 900. The spark plug 900 may be removed from the invention 100 and installed in an engine of a vehicle.

The clamp 200 is a framework that establishes the position of the spark plug holder 250 relative to the threaded shaft 220 and the pressing foot 230. The clamp 200 may generally be C-shaped to place the pressing foot 230 directly above the spark plug holder 250 while not interfering with the positioning of the spark plug 900. The clamp 200 may therefore have a lower arm 202 and an upper arm 204 with the spark plug holder 250 positioned on the lower arm 202 and with the threaded shaft 220 passing through the upper arm 204.

The clamp 200 may be mounted to a workspace surface (not illustrated in the figures). As non-limiting examples, the clamp 200 may be mounted using screws to a wall or to a workbench provided that the spark plug holder 250 has clearance below it to accept the spark plug 900. The threaded shaft 220 is a vertically oriented threaded rod that passes through a shaft hole 206 in the upper arm 204 of the clamp 200. The shaft hole 206 is threaded and the relationship of thread sizes of the threaded shaft 220 and the shaft hole 206 is such that the threaded shaft 220 is free to rotate in the shaft hole 206. Because both the threaded shaft 220 and the shaft hole 206 are threaded, when the threaded shaft 220 is turned in the shaft hole 206, the threaded shaft 220 will move in a vertical direction relative to the shaft hole 206. Specifically, the threaded shaft 220 will move downwards if the threaded shaft 220 is turned in a first rotational direction 222 and the threaded shaft 220 will move upwards if the threaded shaft 220 is turned in a second rotational direction 224.

The upper end of the threaded shaft 220 is coupled to the handle 210. The handle 210 provides a grasping point for an operator to turn the threaded shaft 220. The lower end of the threaded shaft 220 is coupled to the pressing foot 230 which applies bending pressure to the lateral electrode 920 of the spark plug 900 when the spark plug 900 is installed in the spark plug holder 250 and the threaded shaft 220 is moved downwards.

The gauge mount 240 allows one of the one or more gap gauges 300 to be removably coupled to the clamp 200 at a position where the one or more gap gauges 300 will be at the correct height to align with the spark plug 900 that has been installed at the spark plug holder 250. In addition, the one of the one or more gap gauges 300 installed at the gauge mount 240 will be at a distance away from the spark plug 900 that allows the one of the one or more gap gauges 300 to be rotated into position where a calibrated arm 320 of the one of the one or more gap gauges 300 will pass between the central electrode 910 of the spark plug 900 and the lateral electrode 920 of the spark plug 900.

The spark plug holder 250 may be a threaded hole in the lower arm 202, which is oriented to pass vertically through the lower arm 202. The diameter of the spark plug holder 250, the reach length of the spark plug holder 250, and the thread size of the spark plug holder 250 are selected in advance to match a specific type of spark plug. Because spark plugs of various sizes exist, the invention 100 may be offered for sale as a family of the spark plug gapping tools 100 with each member of the family appropriate for a specific size of the spark plug 900. If the invention 100 and the spark plug 900 match, then the spark plug 900 will thread into the spark plug holder 250 from below with the spark plug 900 held in an inverted position. The lateral electrode 920 of the spark plug 900 and the central electrode 910 of the spark plug 900 will protrude from the spark plug holder 250, above the lower arm 202.

Each of the one or more gap gauges 300 comprises a mounting clip 310 and the calibrated arm 320. The mounting clip 310 allows the one or more gap gauges 300 to removably couple to the gauge mount 240 on the clamp 200. The calibrated arm 320 is a 'feeler gauge', which is fabricated to be a specific thickness. With the spark plug 900 in place in the spark plug holder 250, one of the one or more gap gauges 300 is installed on the clamp 200 at the gauge mount 240 and then rotated around the gauge mount 240 to place the calibrated arm 320 of the one of the one or more gap gauges 300 between the central electrode 910 of the spark plug 900 and the lateral electrode 920 of the spark plug 900. The spark plug 900 is rotated within the spark plug holder 250 to raise the spark plug 900 until the central electrode 910 of the spark plug 900 touches the bottom side of the calibrated arm 320. The pressing foot 230 is then used to bend the lateral electrode 920 down towards the calibrated arm 320.

When the lateral electrode 920 reaches the calibrated arm 320 and the calibrated arm 320 occupies all of the space between the central electrode 910 and the lateral electrode 920, then the calibrated arm 320 can be removed from the spark plug 900 by rotating the one of the one or more gap gauges 300 and the gap width of the spark plug 900 will be set to match the thickness of the calibrated arm 320. Since each of the one or more gap gauges 300 are a slightly different thickness, each of the one or more gap gauges 300 may be marked to indicate the thickness of the calibrated arm 320. As a non-limiting example, the thickness of the calibrated arm 320 may be stamp, etched, or printed on each of the one or more gap gauges 300.

Although the invention 100 has been described as comprising the clamp 200 which accepts an inverted spark plug into the bottom of the clamp 200, those skilled in the art will recognize that other orientations of the clamp 200 which accept the spark plug 900 into the top side of the clamp 200 or which accept the spark plug 900 into a side of the clamp 200 are possible and that such alternative orientations do not depart from the from the spirit and scope of the invention 100.

In use, one of the one or more gap gauges 300 is selected based upon the gap width that is desired and the selected one of the one or more gap gauges 300 is installed onto the clamp 200 at the gauge mount 240. The spark plug 900 may be prepped for adjustment by prying the lateral electrode 920 away from the central electrode 910 to assure that the selected one of the one or more gap gauges 300 is narrower than the gap width initially. The spark plug 900 is installed into the spark plug holder 250 from the bottom while the spark plug 900 is held in an inverted position. The spark plug 900 is threaded into the spark plug holder 250 and turned until the lateral electrode 920 clears the lower arm 202 of the clamp 200.

A final height adjustment may be performed by rotating the selected one of the one or more gap gauges 300 so that the calibrated arm 320 enters the space between the central electrode 910 and the lateral electrode 920 and then continuing to rotate the spark plug 900 so that it moves up in the spark plug holder 250 until the central electrode 910 of the spark plug 900 touches the bottom of the calibrated arm 320 of the selected one of the one or more gap gauges 300. The handle 210 may then be moved so that the threaded shaft 220 rotates in the first rotational direction 222 which will lower the pressing foot 230 against the lateral electrode 920 of the spark plug 900. Continued rotation of the threaded shaft 220 will push the lateral electrode 920 down until it is pressed against the calibrated arm 320. The handle 210 may then be moved in the opposite direction so that the threaded shaft 220 rotates in the second rotational direction 224 which will raise the pressing foot 230 away from the spark plug 900. The calibrated arm 320 may be removed from the spark plug 900 and the spark plug 900 may then be rotated out of the spark plug holder 250. At this point, the spark plug 900 is ready to install in the engine of the vehicle and a different spark plug may be gapped using the invention 100.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A spark plug gapping tool comprising:

a clamp, a handle, a threaded shaft, a pressing foot, a gauge mount, a spark plug holder and one or more gap gauges;

wherein the spark plug gapping tool accepts a spark plug into the spark plug holder;

wherein the pressing foot bends a lateral electrode of the spark plug until a gap width of the spark plug is set correctly as determined by having one of the one or more gap gauges fill the space between a central electrode of the spark plug and the lateral electrode of the spark plug;

wherein the clamp is a framework that establishes the position of the spark plug holder relative to the threaded shaft and the pressing foot;

wherein the clamp places the pressing foot directly above the spark plug holder;

wherein the clamp comprises a lower arm and an upper arm;

wherein the spark plug holder positioned on the lower arm;

wherein the threaded shaft passes through the upper arm;

wherein the clamp is mounted to a workspace surface;

wherein the threaded shaft is a vertically oriented threaded rod that passes through a shaft hole in the upper arm of the clamp;

wherein the shaft hole is threaded;

wherein the thread size of the threaded shaft and thread size for the shaft hole are such that the threaded shaft is free to rotate in the shaft hole;

wherein when the threaded shaft is turned in the shaft hole, the threaded shaft will move in a vertical direction relative to the shaft hole;

wherein the threaded shaft will move downwards if the threaded shaft is turned in a first rotational direction;

wherein the threaded shaft will move upwards if the threaded shaft is turned in a second rotational direction;

wherein the upper end of the threaded shaft is coupled to the handle;

wherein the handle is adapted to provide a grasping point for an operator to turn the threaded shaft;

wherein the lower end of the threaded shaft is coupled to the pressing foot;

wherein the pressing foot applies bending pressure to the lateral electrode of the spark plug when the spark plug is installed in the spark plug holder and the threaded shaft is moved downwards;

wherein the gauge mount allows the one of the one or more gap gauges to be removably coupled to the clamp;

wherein the gauge mount located in a position where the one of the one or more gap gauges that is removably coupled to the clamp aligns with spark plug electrodes;

wherein the gauge mount located in a position where the one of the one or more gap gauges removably coupled to the gauge mount is at a distance away from the spark plug that allows a calibrated arm of the one of the one or more gap gauges to pass between the central electrode of the spark plug and the lateral electrode of the spark plug;

wherein the spark plug holder is a threaded hole in the lower arm which is oriented to pass vertically through the lower arm;

wherein the spark plug threads into the spark plug holder from below with the spark plug held in an inverted position;

wherein the lateral electrode of the spark plug and the central electrode of the spark plug protrude from the spark plug holder above the lower arm;

wherein each of the one or more gap gauges comprise a mounting clip and the calibrated arm;

wherein the mounting clip allows the one or more gap gauges to removably couple to the gauge mount on the clamp.

2. The spark plug gapping tool according to claim 1 wherein the calibrated arm is a feeler gauge which is fabricated to be a specific thickness.

3. The spark plug gapping tool according to claim 2 wherein the one of the one or more gap gauges is installed on the clamp at the gauge mount;

wherein the one of the one or more gap gauges rotates around the gauge mount to place the calibrated arm of the one of the one or more gap gauges between the central electrode of the spark plug and the lateral electrode of the spark plug.

4. The spark plug gapping tool according to claim 3 wherein the spark plug is rotated within the spark plug holder to raise the spark plug until the central electrode of the spark plug touches the bottom side of the calibrated arm;

wherein the pressing foot is used to bend the lateral electrode down towards the calibrated arm.

5. The spark plug gapping tool according to claim 4 wherein each of the one or more gap gauges are marked to indicate the thickness of the calibrated arm.

* * * * *